United States Patent [19]

Jess

[11] Patent Number: 4,500,269

[45] Date of Patent: Feb. 19, 1985

[54] INTEGRAL TUBE-LOADING ASSEMBLY FOR PERISTALTIC PUMP

[75] Inventor: Thurman S. Jess, Lydonville, N.Y.

[73] Assignee: Cormed, Inc., Medina, N.Y.

[21] Appl. No.: 556,370

[22] Filed: Nov. 30, 1983

[51] Int. Cl.[3] ..... F04B 43/12; F04B 45/08

[52] U.S. Cl. ..... 418/45; 417/476

[58] Field of Search ..... 418/45; 417/474, 475, 417/476, 477

[56] References Cited

U.S. PATENT DOCUMENTS

| | | | |
|---|---|---|---|
| 3,109,383 | 11/1963 | Muller . | |
| 3,756,752 | 9/1973 | Stenner | 417/477 |
| 3,963,023 | 6/1976 | Hankinson | 128/214 |
| 4,138,205 | 2/1979 | Wallach | 417/360 |
| 4,211,519 | 7/1980 | Hogan | 417/360 |

FOREIGN PATENT DOCUMENTS

| | | | |
|---|---|---|---|
| 643482 | 4/1937 | Fed. Rep. of Germany | 417/476 |
| WO81/01728 | 6/1981 | PCT Int'l Appl. | 418/45 |
| WO82/03254 | 9/1982 | PCT Int'l Appl. | 418/45 |
| WO83/04285 | 12/1983 | PCT Int'l Appl. | 417/476 |

*Primary Examiner*—Richard E. Gluck

*Attorney, Agent, or Firm*—Joseph P. Gastel

[57] ABSTRACT

An integral tube-loading assembly for a peristaltic pump having an eccentric rotor shaft mounting a rotor within a housing wall including a trunnion mounted on the rotor shaft, a first link pivotally mounted on the trunnion, a second link pivotally mounted on the first link, a tube-loading pin member carried in a slot in the second link, the trunnion and first and second links being positioned on the rotor so that the pin member is always directed at the maximum spacing between the rotor and the housing wall, and a threaded bore in the rotor for receiving the pin member in a stowed condition.

12 Claims, 13 Drawing Figures

Fig. 1.
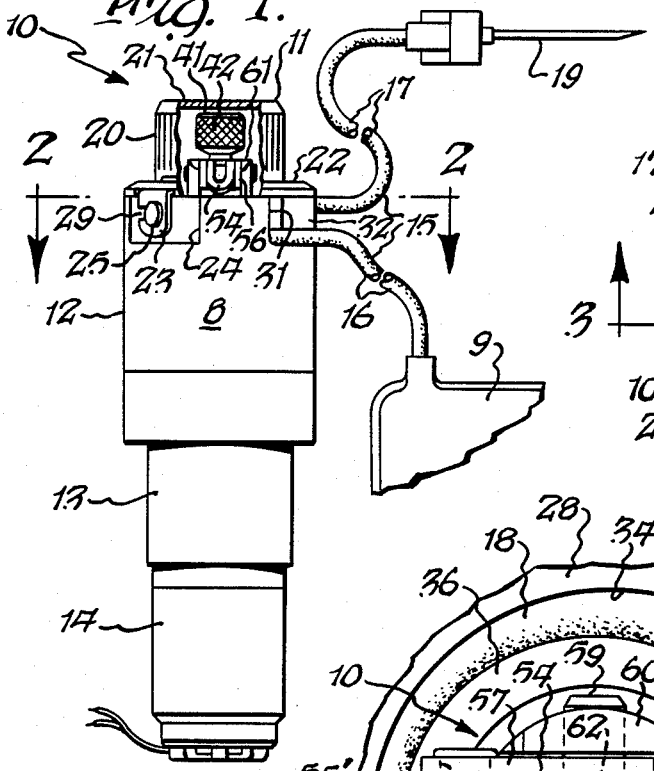
Fig. 2.
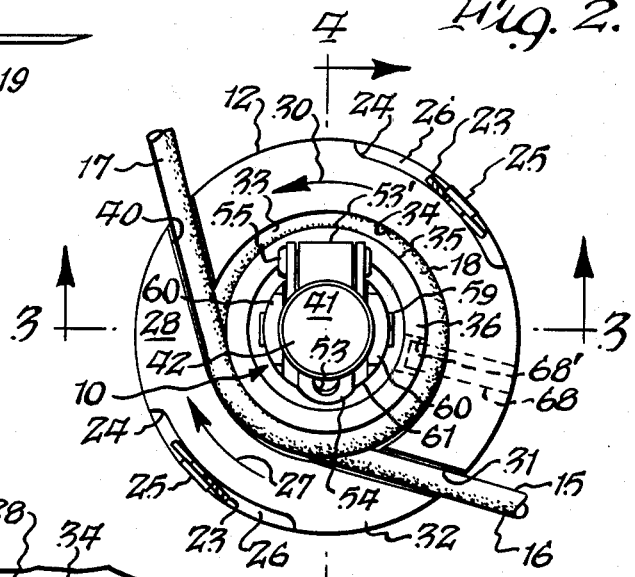
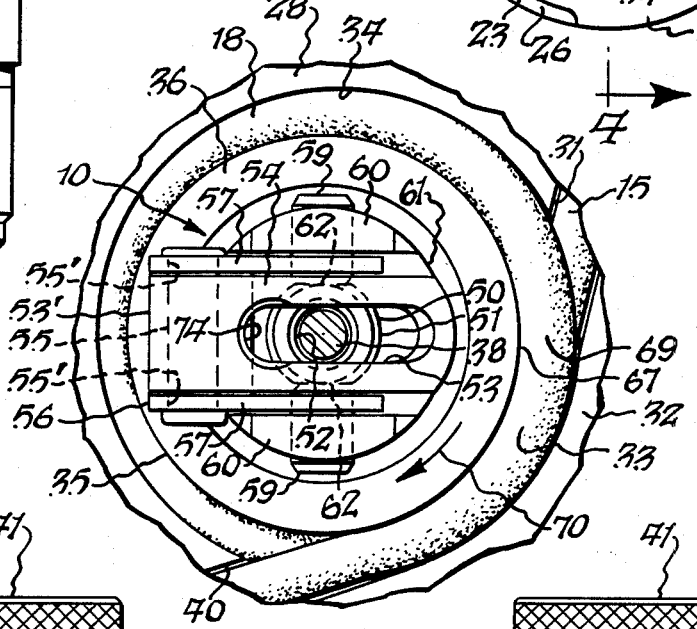
Fig. 5.
Fig. 3.
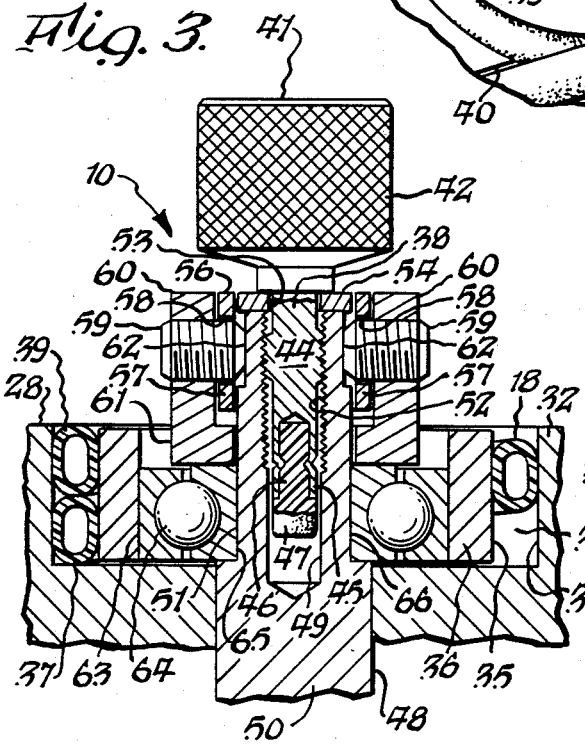
Fig. 4.
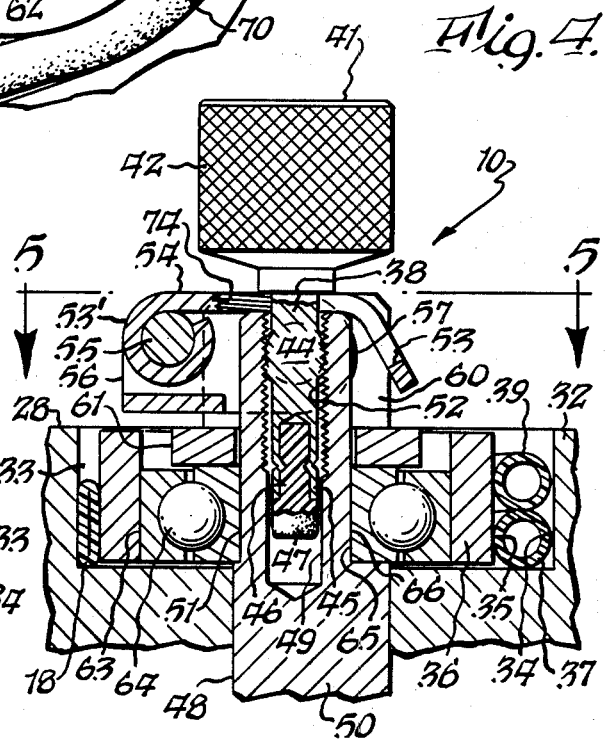

INTEGRAL TUBE-LOADING ASSEMBLY FOR PERISTALTIC PUMP

BACKGROUND OF THE INVENTION

The present invention relates to an improved structure for loading a flexible tube into a peristaltic pump.

By way of background, a peristaltic pump includes an eccentrically mounted rotor which advances and recedes relative to the wall of a pump housing to effect pumping of fluid through a tube located therebetween. Periodically this tube must be changed. However, to insert a new tube, it must be progressively pressed downwardly into the portion of maximum spacing between the rotor and the housing. In one type of prior device, this was achieved by coupling a separate rotor-turning member to the rotor to turn it, and a separate pin member was used to press the flexible tube into the maximum open space progressively obtained between the rotor and the housing, as the rotor was rotated by the rotor-turning member. This was awkward and inconvenient in that the rotor-turning member, which was a threaded pin which was inserted into the rotor, could be lost because it was not permanently attached to the rotor, and if it was lost, the rotor could not be turned manually. Furthermore, since the rotor-turning member was a relatively small part, it was frequently dropped and had to be retrieved. In addition, since the tube-inserting member was also not attached to the pump, it also was frequently dropped, and, if lost, a substitute had to be used which may not have had the capability to function properly. It is with overcoming the foregoing deficiencies of one prior type of tube-loading apparatus for a peristaltic pump that the present invention is concerned.

SUMMARY OF THE INVENTION

It is accordingly one object of the present invention to provide an improved tube-loading construction for a peristaltic pump in which a tube-loading pin member is attached to the rotor in such a manner that it is always directed at the area of maximum spacing between the rotor and the pump housing side wall so that the tube can be pressed into this maximum space, without requiring visual alignment of the rotor to obtain such maximum spacing.

Another object of the present invention is to provide an improved tube-loading structure for a peristaltic pump wherein the tube-loading pin member is secured to the rotor by means of a collapsible and extendible linkage, which not only permanently secures the pin member to the rotor, but also acts as a lever to turn the rotor when the linkage is extended for inserting the tube between the rotor and the housing.

A further object of the present invention is to provide an improved tube-loading structure for a peristaltic pump wherein a tube-loading pin member is permanently secured to the rotor by means of an extendible and collapsible linkage and is normally stowed in the rotor when not in use.

Yet another object of the present invention to provide an improved tube-loading construction for a peristaltic pump in which the parts are all connected to the rotor so that they cannot be dropped or lost. Other objects and attendant advantages of the present invention will readily be perceived hereafter.

The present invention relates to an improvement in a tube-loading construction for a peristaltic pump having a housing with an inner wall, a rotor having an outer wall, a flexible tube for insertion between said inner and outer walls, and means mounting said rotor for eccentric movement within said housing with said inner wall spaced from said outer wall, said eccentric movement causing a portion of said outer wall of said rotor to progressively recede from said inner wall during rotation of said rotor so as to accommodate said flexible tube in a relatively uncompressed state, the improvement comprising a device for inserting said tube between said inner and outer walls comprising a pin member including a tube inserting end and a digital grasping end and a central portion therebetween, and linkage means mounting said pin member relative to said rotor for causing said tube inserting end to always be aligned with said portion of said outer wall of said rotor so that the tube inserting end of said pin member can progressively press portions of said tube in a relatively uncompressed state between said inner and outer walls as said rotor is caused to rotate. The various aspects of the present invention will be more fully understood when the following portions of the specification are read in conjunction with the accompanying drawings wherein:

BRIEF DESCRIPTION OF THE DRAWINGS

FIG. 1 is a side elevational view of the improved peristaltic pump of the present invention along with fragmentary representations of portions of the flexible tube and other structure associated therewith;

FIG. 2 is a view of the top of the pump with its cover removed taken substantially in the direction of arrows 2—2 of FIG. 1;

FIG. 3 is a fragmentary cross sectional view taken subtantially along line 3—3 of FIG. 2;

FIG. 4 is a fragmentary cross sectional view taken substantially along line 4—4 of FIG. 2;

FIG. 5 is a fragmentary plan view taken substantially along line 5—5 of FIG. 4;

DESCRIPTION OF THE PREFRRED EMBODIMENTS

Figures 6, 7, 8, 9, 10, 11, 12, 13:
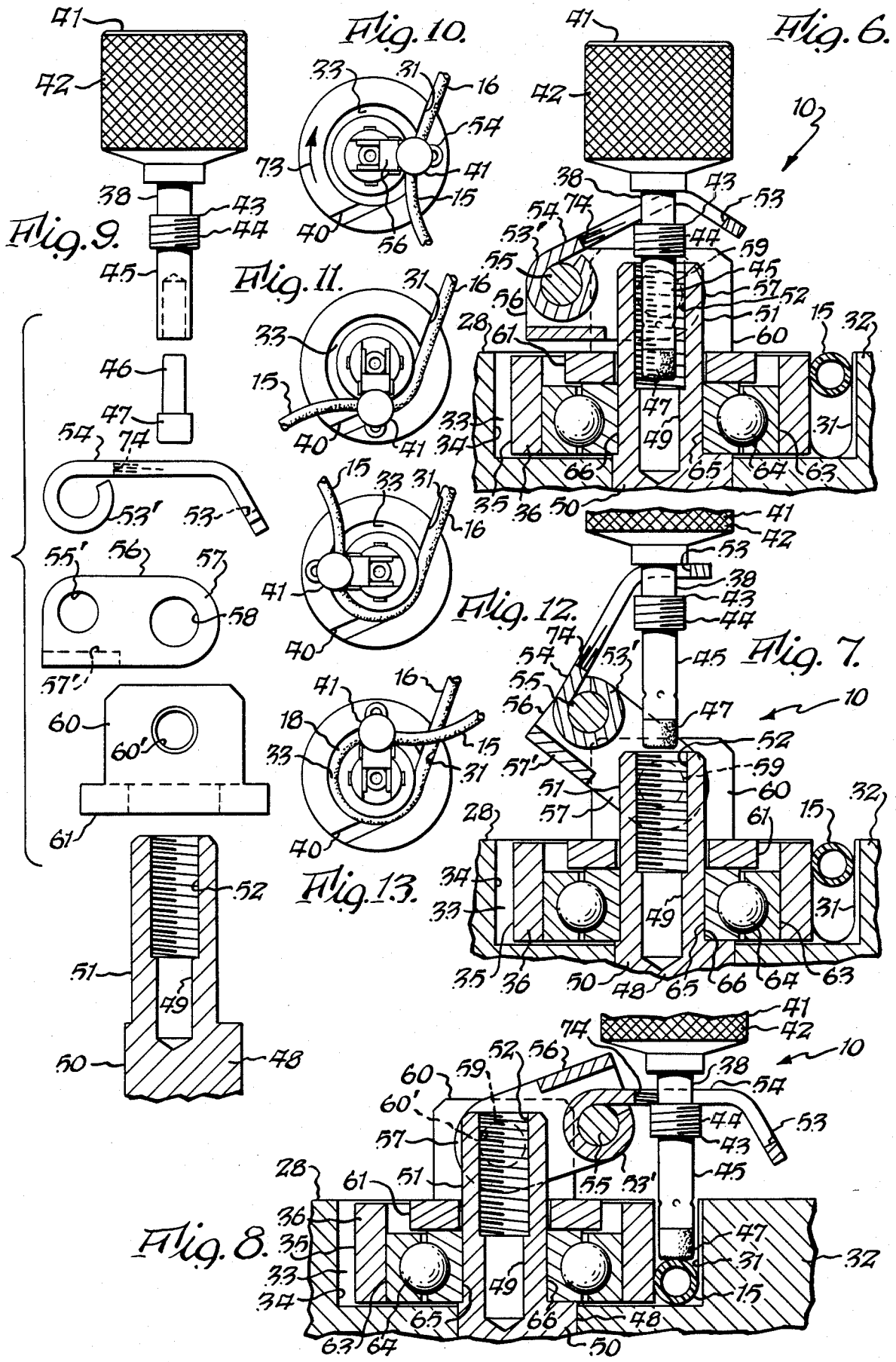
FIG. 6 is a fragmentary cross sectional view similar to FIG. 4 but showing the relationship of the various parts when the pin member is partially removed from its stowed position in the rotor shaft.
FIG. 7 is a view similar to FIG. 6 and showing the positions of the various parts when the pin member is fully removed from its stowed position.
FIG. 8 is a view similar to FIG. 7 but showing the pin member and its associated structure when the pin member has been moved to its tube installing position with its end within the space between the outer surface of the rotor and the inner surface of the housing.
FIG. 9 is a fragmentary exploded side elevational view of the various parts of the tube loading structure.
FIGS. 10–13 are schematic views showing the pin member in four progressive positions 90° from each other and also showing the relationship of the maximum spacing between the rotor and the housing at such pin positions.

The improved tube loading structure 10 of the present invention is located under cap 11 which is mounted on housing 12 of peristaltic pump 8 which is driven by gear reducer 13 which in turn is driven by electric motor 14. In operation, pump 8 pumps suitable medication from plastic medication bag 9 through inlet portion 16 of flexible resilient plastic tube 15, through central tube portion 18 and out of tube outlet portion 17 to needle 19 which is inserted in a patient's body.

Cap 11 includes a hollow cylindrical portion 20 having a closed upper end 21 and an annular flange 22 at its lower end. Diametrically opposed slotted ears 23 are secured to flange 22 and depend downwardly therefrom. The opposite sides of housing 12 are recessed at 24, and headed pin members 25 protrude therefrom. Cap 11 is installed by inserting ears 23 into spaces 26, placing flange 22 on top 28 of pump housing 12 and thereafter twisting cap 11 in the direction of arrow 27 until pins 25 are received in slots 29 of ears 23. To remove cap 11 to expose the tube loading structure 10 of the present invention, cap 11 is rotated in the direction of arrow 30 until ears 23 clear pins 25, and thereafter cap 11 is lifted.

In peristaltic pump structures of the present type, the entry portion 16 of tube 15 lies in slot 31 in housing wall 32. A space 33 of varying width is located between the inner surface 34 of housing wall 32 and the outer surface 35 of eccentrically mounted rotor 36. The central portion 18 of tube 15 encircles rotor 36 and is located in space 33. As can be seen from FIGS. 2, 3 and 4, the central portion 18 of tube 15 includes a lower run 37 and an upper run 39 which overlaps lower run 37 between entry slot 31 and exit slot 40 in housing wall 32. Essentially the central portion of tube 18 between slots 31 and 40 has a length of about 450°. As is well understood in the art, as rotor 36 oscillates, the outer wall of the rotor will progressively advance and recede from the inner surface 34 of housing wall 32 to thereby cause fluid in tube 15 to be pumped from inlet portion 16 to outlet portion 17 as the central portion of tube 18 is progressively fully closed to the condition at the left of FIG. 4 from the open condition shown at the right side of FIG. 4.

As stated briefly above, the existing tube 15 has to be removed at times from space 33 and a new tube, which is generally attached to a new bag 9, has to be inserted. In the past, the insertion of the tube into the space 33 between the rotor 36 and the housing wall 32 was an awkward procedure. In this regard, a rotor turning member had to be screwed into the rotor to turn the rotor, and then the rotor had to be turned until the maximum space between the rotor and pump housing was proximate the inlet slot 31. Thereafter, a separate tube-inserting pin was used to press the tube into the maximum space. The rotor then had to be turned by the use of the rotor-turning member to advance the maximum space a small amount and the separate pin was again used to press the tube into the maximum space. This procedure was followed for the entire length of approximately 450° of central tube portion 18 in space 33, and thereafter the tube outlet portion was pressed into outlet slot 40. The rotor-turning member then had to be removed from the rotor, and the rotor-turning member and the tube-inserting pin then had to be stored in the case in which the pump was located. If the rotor-turning member was lost, it was virtually impossible to turn the rotor to install a new tube. In addition, if the tube-inserting pin was lost, a substitute had to be used which often did not perform the intended function properly. Thus, tube insertion in the past was an awkward and inconvenient procedure.

The integral tube loader assembly of the present invention overcomes the above-described shortcomings inasmuch as a tube-inserting pin and an associated linkage for turning the rotor are normally retained in a stowed condition on the rotor when they are not in use, and they are selectively extended, while remaining connected to the rotor, to both turn the rotor and insert the tube into the space between the rotor and the housing wall.

The improved integral tube loader construction 10 of the present invention includes a tube-inserting pin 41 having a knurled digital-grasping head 42 connected to a central portion 43 which includes a neck portion 38 connected to an enlarged threaded portion 44 which is above the lower portion 45 which receives the shank 46 attached to plastic tip 47 which is used to press the central portion 18 of the tube into space 33. Normally tube-inserting pin 41 is stowed in bore 49 of rotor shaft 50. In this respect, the upper portion 51 of shaft 50 includes a tapped bore 52 which receives threaded pin portion 44 in mating engagement, as shown in FIGS. 3 and 4. The neck portion 38 of pin 41 is received in elongated slot 53 (FIG. 5) of pivot arm or link 54 which has curled end portion 53′ pivotally mounted on pin 55 secured in bores 55′ of link or swing bracket 56. Arms 57 of swing bracket 56 are connected to each other by integral member 57′ and are pivotally mounted on set screws 59 which extend through oversized bores 58 in arms 57. Set screws 59 are threaded into tapped bores 60′ of standards 60 of trunnion block or saddle 61 which is secured to portion 51 of rotor shaft 50 by said set screws 59, the latter bearing on diametrically opposed flats 62 (FIG. 3) of the eccentric portion 51 of rotor shaft 50.

Rotor 36 is press-fitted onto the outer surface 63 of ball-bearing assembly 64, the inner surface 65 of which is press-fitted onto the outer surface 66 of rotor shaft portion 51 which is mounted off-center to the lower portion 48 of the rotor shaft. It can thus be seen that as shaft 50 rotates, rotor 36 will be caused to oscillate in the above-described manner. A pin 68 extends through housing wall 32 into an oversized bore 68′ in rotor 36 to hold rotor 36 from rotating as it oscillates, pin 68 lying below the single run of the tube portion 18 shown in FIG. 3.

The flats 62 on opposite sides of rotor shaft portion 51 are located in a position so that when saddle or trunnion 61 is secured to shaft portion 51 in the above-described manner, elongated slot 53 of link 54 will be in line with the portion of outer rotor surface 35 which will be spaced the maximum distance from housing wall 32. This can be seen most clearly from FIG. 5 wherein area 67 on rotor surface 35 is at the widest portion 69 of space 33. It will further be appreciated that as rotor 36 moves in the direction of arrow 70, portion 67 on the outside of the rotor will always be at the maximum space between the rotor and the inner surface 34 of the housing side wall.

In order to insert tube 15 into the space 33 of pump 8, tube-inserting pin 41 is unthreaded from tapped bore 52 and link 54 is thus moved to the position shown in FIG. 6 because it can pivot about pin 55. It is actually the upper end of threaded pin portion 44 which bears on the undersurface of link 54 which raises it to the position of FIG. 6 because slot 53 is of less width than the diameter of threaded portion 44. The tube-inserting pin is then removed from rotor shaft bore 49 to the position shown in FIG. 7 and links 54 and 56 will move to the positions shown in FIG. 7 because the swing bracket 56 can pivot about set screws 59 which are located in oversize bores 58 therein. The tube-inserting pin 41 is then moved radially outwardly as links 54 and 56 are extended and the plastic tip 47 can be used to force tube portion 16 into lead-in groove 31. Thereafter, pin 41 is moved to the position of FIG. 8 to push the initial part of tube portion 18 into space 33 which is at its maximum opening proximate slot 31 because pin 41 is located at this position.

The rotor is then rotated in the direction of arrow 73 (FIG. 10) by moving pin 41 in that direction with its tip in space 33. The extended links 54 and 56 will act as a lever arm to rotate rotor 36. It will be appreciated, as can be seen from the sequence in FIGS. 10–13, that as pin 41 rotates clockwise in the direction of arrow 73 to its various positions, it will always be at the position of maximum spacing between the outer surface 35 of rotor 36 and the inner surface 34 of housing wall 32. Thus, while the tip 47 of tube-inserting pin 41 is within space 33, it will progressively push portions of tube 18 into space 33. This procedure is continued until a portion of tube 15 is in alignment with tube outlet portion 17, whereupon pin 41 may be withdrawn from space 33 and the linkage 54, 56 may be extended so that the pin tip 47 may be used to press the tube into slot 40. After the tube has been fully inserted in slots 31 and 40 and in the space 33, the pin 41 is moved to the position shown in FIG. 7, the end of pin 41 is inserted into bore 49, and thereafter pin 41 is threaded into the position shown in FIGS. 3 and 4. The cap 11 is then mounted onto pump housing 12 in the above-described manner to protect the various parts therein.

It will be appreciated that pin 41 can move different radial distances from the bore 49 in which it is stowed, because neck portion 38 of pin 41 may ride in slot 53 of link 54. It is to be noted that the inner end of slot 53 is tapped at 74, and it is through this tapped portion that pin 41 is installed into slot 53. In this respect, in order to effect this installation, the lower end 45 is inserted through tapped portion 74, then threaded portion 44 is screwed through tapped portion 74 until reduced neck portion 38 is located within the slot, whereupon pin 41 may be moved radially within the slot because the slot is of greater width than the diameter of neck portion 38. However, as noted above, the outer diameter of threaded portion 44 is greater than the width of slot 53 so that pin 41 is retained therein.

It can thus be seen that the improved integral tube loading structure of the present invention is manifestly capable of achieving the above enumerated objects, and while preferred embodiments of the present invention have been disclosed, it will be appreciated that the present invention is not limited thereto, but may be otherwise embodied within the scope of the following claims.

What is claimed is:

1. In a peristaltic pump having a housing with an inner wall, a rotor having an outer wall, a flexible tube for insertion between said inner and outer walls, and means mounting said rotor for eccentric movement within said housing with said inner wall spaced from said outer wall, said eccentric movement causing a portion of said outer wall of said rotor to progressively recede from said inner wall during rotation of said rotor so as to accommodate said flexible tube in a relatively uncompressed state, the improvement comprising a device for inserting said tube between said inner and outer walls comprising a pin member including a tube inserting end and a digital grasping end and a central portion therebetween, and linkage means mounting said pin member relative to said rotor for causing said tube inserting end to always be aligned with said portion of said outer wall of said rotor so that the tube inserting end of said pin member can progressively press portions of said tube in a relatively uncompressed state between said inner and outer walls as said rotor is caused to rotate.

2. In a peristaltic pump as set forth in claim 1 wherein said portion of said outer wall of said rotor is always located at a maximum distance from said inner wall of said housing.

3. In a peristaltic pump as set forth in claim 1 wherein said linkage means includes a first trunnion member in alignment with said rotor and fixed thereon, a first link pivotally mounted on said trunnion for movement radially toward and away from said portion of said outer wall of said rotor, a second link pivotally mounted on said first link for movement radially toward and away from said portion of said rotor, and mounting means mounting said central portion of said pin member on said second link.

4. In a peristaltic pump as set forth in claim 3 wherein said mounting means comprises an elongated slot in said second link.

5. In a peristaltic pump as set forth in claim 4 including a tapped bore located substantially centrally in said rotor, and a threaded portion on said central portion of said pin member for mating engagement with said tapped bore for stowing said pin member.

6. In a peristaltic pump as set forth in claim 5 wherein said elongated slot includes a first portion which is of less width than the effective diameter of said threaded portion of said pin member, a reduced portion on said pin member between said threaded portion and said digital grasping end which is of less diameter than said width of said slot whereby said reduced portion can slide in said elongated slot while said threaded portion prevents said pin member from being separated from said elongated slot.

7. In a peristaltic pump as set forth in claim 6 including a second tapped portion in communication with said elongated slot for permitting said threaded portion of said pin member to be threaded therethrough to thereby mount said pin member on said elongated link.

8. In a peristaltic pump as set forth in claim 7 wherein said digital grasping end comprises an enlarged head.

9. In a peristaltic pump as set forth in claim 3 wherein said first and second links assume an extended condition when said pin member is in alignment with the space between said inner and outer walls to thereby function as a lever arm for turning said rotor.

10. In a peristaltic pump as set forth in claim 3 including a tube lead-in slot in said housing, and a tube lead-out slot in said housing, said tube lead-in slot and said tube lead-out slot extending generally tangentially to said rotor, and said first and second links being extendible to permit said pin member to press said tube into said lead-in slot and said lead-out slot.

11. In a peristaltic pump having a housing with an inner wall, a rotor having an outer wall, a flexible tube for insertion between said inner and outer walls, and means mounting said rotor for eccentric movement within said housing with said inner wall spaced from said outer wall, said eccentric movement causing a portion of said outer wall of said rotor to progressively recede from said inner wall during rotation of said rotor so as to accommodate said flexible tube in a relatively uncompressed state, the improvement comprising a device for inserting said tube between said inner and outer walls comprising a pin member including a tube inserting end and a digital grasping end and a central portion therebetween, and linkage means having a first portion secured to said rotor and a second portion mounting said pin member, means for permitting said linkage means to move between extended and collapsed conditions, said tube inserting end of said pin member being in a position to enter said space between said inner and outer walls when said linkage is in said extended condition while said pin member is mounted on said linkage, and said linkage in said extended condition functioning as a lever to turn said rotor.

12. In a peristaltic pump as set forth in claim 11 including a shaft for mounting said rotor, and a bore in said shaft for receiving said pin member in a stowed condition when said linkage means is in said collapsed condition.

* * * * *